US008061164B2

(12) United States Patent
Johnston et al.

(10) Patent No.: US 8,061,164 B2
(45) Date of Patent: Nov. 22, 2011

(54) ANTI-THEFT DEVICE FOR LAPTOP COMPUTER OR PORTABLE ELECTRONIC PRODUCT

(75) Inventors: Michael R. Johnston, Waxhaw, NC (US); John F. Roberts, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 45 days.

(21) Appl. No.: 12/610,644

(22) Filed: Nov. 2, 2009

(65) Prior Publication Data

US 2011/0100073 A1 May 5, 2011

(51) Int. Cl.
*E05B 69/00* (2006.01)

(52) U.S. Cl. ..... 70/58; 70/14; 70/18; 70/211; 248/553

(58) Field of Classification Search ..... 70/14, 18, 70/19, 30, 49, 53, 57, 58, 211; 248/551–553; 361/683, 686
See application file for complete search history.

(56) References Cited

U.S. PATENT DOCUMENTS 465,450 A * 12/1891 Brooke ..... 70/26
1,380,719 A * 6/1921 Johnson ..... 70/49
1,539,301 A * 5/1925 Cooper ..... 70/49
5,052,199 A * 10/1991 Derman ..... 70/58
5,595,074 A 1/1997 Munro
5,836,183 A 11/1998 Derman
6,138,483 A * 10/2000 Galant ..... 70/58
6,216,499 B1 4/2001 Ronberg et al.
6,308,928 B1 10/2001 Galant
6,389,853 B1 5/2002 Pate et al.
6,443,417 B2 9/2002 Galant
6,560,710 B1 5/2003 Leyden et al.
6,578,394 B2 6/2003 Yin
6,763,690 B2 7/2004 Galant
7,007,912 B1 3/2006 Giuliani et al.
7,174,752 B2 2/2007 Galant
7,315,443 B2 1/2008 Allen
7,324,333 B2 1/2008 Allen
7,370,840 B1 5/2008 Deconinck
7,387,003 B2 6/2008 Marszalek et al.
7,443,665 B2 10/2008 Allen
7,487,652 B2 * 2/2009 Marszalek et al. ..... 70/58
7,487,682 B2 2/2009 Gruber
7,499,269 B2 3/2009 Allen
2004/0074264 A1 4/2004 Kung et al.
2005/0039502 A1 2/2005 Avganim
2007/0290115 A1 12/2007 Meyer
2008/0168811 A1 * 7/2008 Nagelski ..... 70/276

* cited by examiner

*Primary Examiner* — Suzanne Barrett
(74) *Attorney, Agent, or Firm* — Christopher C. Dremann, P.C.; Christopher C. Dremann

(57) ABSTRACT

An anti-theft device for protecting a laptop computer or similar portable electronic product from theft or unauthorized removal includes at least one retaining assembly including a laterally extending retaining arm terminating in a retaining hook for engaging a lateral edge of the laptop computer or similar portable electronic product, a retaining leg depending from the retaining arm and a retaining base for receiving the retaining leg in a locked configuration. The retaining arm is adjustable to accommodate laptop computers or similar portable electronic products having various widths and a lock mechanism includes a shuttle fixed to a collar made of a magnetically attractive material and a biasing spring for biasing the shuttle into engagement with the retaining leg of the retaining arm. The lock mechanism is operable with a magnetic key to impart a magnetic attraction force to the shuttle to move the shuttle out of engagement with the retaining leg of the retaining arm and thereby permit the retaining arm to move to an unlocked configuration.

18 Claims, 11 Drawing Sheets

ANTI-THEFT DEVICE FOR LAPTOP COMPUTER OR PORTABLE ELECTRONIC PRODUCT

BACKGROUND OF THE INVENTION

This invention relates generally to an anti-theft device for protecting consumer electronics, and in particular, a laptop computer or similar portable electronic product (e.g. DVD player). More particularly, the invention relates to an anti-theft device for protecting a laptop computer or similar portable electronic product having a base portion and a cover portion attached to the base portion with the cover portion positionable at an angle relative to the base portion. The anti-theft device is adjustable to accommodate laptop computers and similar portable electronic products having various widths, and includes a lock mechanism operable for automatically locking the anti-theft device and a magnetic key operable for unlocking the anti-theft device.

It is common practice for retailers to provide demonstration models of relatively expensive consumer electronics, such as laptop computers and similar portable electronic products, so that a potential purchaser may examine the demonstration model, and in some instances, test the function and operation of its features prior to purchasing the product. As used herein, the term "laptop computer" is intended to refer generically to all types of portable, personal computers, including notebook, mini-notebook, sub-notebook and netbook type computers, as well as personal data assistant (PDA) devices. The term "similar electronic product" is intended to refer generically to any type of portable, personal education and/or entertainment device, such as a digital video disc (DVD) player, karaoke machine, and the like. An operational display product, however, also creates an opportunity for the demonstration model to be stolen or removed from the display area by an unauthorized person. As a result, demonstration models of consumer electronics are typically protected by an anti-theft device, also commonly referred to as a "security device" or "merchandise display device," that permits a potential purchaser to examine and operate the demonstration model, while reducing the likelihood that the display product will be stolen or removed by an unauthorized person.

Certain consumer electronics are more difficult to protect than others. For example, cell phones and digital cameras are relatively small and include removable components that are easily separated from one another. Cell phones and digital cameras commonly include a battery pack (or one or more individual batteries) and a memory card for storing video, audio and/or data files. The display product and each removable component must be separately secured against theft without interfering with the ability of the potential purchaser to examine and operate the demonstration model. This requirement typically results in the use of a security device having multiple electronic sensors placed at different locations on the product. The use of multiple electronic sensors can make it more difficult for the potential purchaser to operate the demonstration model, and thus adversely influence the decision to purchase. Furthermore, the provision of multiple electronic sensors necessarily increases the cost and complexity of the security device. As a result of its increased complexity, there is a corresponding increased likelihood that the device may malfunction and produce a false indication of theft.

Laptop computers and similar portable electronic products are typically larger in size and have a base portion and a cover portion attached to the base portion that is more difficult to separate. Regardless, demonstration models of such products are likewise problematic to protect since access to the various input devices and ports must be provided without hindering the ability and freedom of the potential purchaser to examine and operate the display product. For example, all essential keyboard components must be readily accessible and the cover portion, which typically includes a display screen, must be clearly visible with only minimal obstruction. Furthermore, a suitable anti-theft device must be able to accommodate the various widths and thicknesses of different models and brands of the demonstration model without compromising the security of the display product. A particular concern for securing a demonstration model of a laptop computer or similar portable electronic product against theft is that providing adjustment of the anti-theft device in one dimension (e.g., width) may compromise or diminish security of the display product by the anti-theft device in another dimension (e.g., height or thickness). In particular, securing the demonstration model against removal from the anti-theft device in the lateral direction may cause the display product to be more vulnerable to removal from the anti-theft device in the vertical direction.

Known anti-theft devices for protecting laptop computers and similar portable electronic products having a base portion and a cover portion attached to the base portion include a conventional mechanical lock (e.g. key and tumbler; padlock; etc.) for locking the anti-theft device onto the laptop computer or similar portable electronic product. As a result, such anti-theft devices are vulnerable to attack by common means, such as picking the key lock and cutting the shank of the padlock. In addition, the keys used with conventional mechanical locks can be readily duplicated, and thus, are subject to circulation. Further, conventional mechanical locks used for locking the anti-theft device onto the laptop computer or similar portable electronic product typically secure the anti-theft device at only a single location. Still further, known anti-theft devices utilize conventional mechanical locks that do not automatically lock when the anti-theft device is positioned onto the laptop computer or similar portable electronic product. Accordingly, it is possible for store personnel to inadvertently fail to lock the anti-theft device when assembling the product display.

Accordingly, there exists an unresolved need for a simple, yet reliable and effective, anti-theft device for protecting a laptop computer or similar portable electronic product. There exists a specific need for such an anti-theft device having a base portion and a cover portion attached to the base portion with the cover portion extending from the base portion at an angle. There exists another specific need for such an anti-theft device that is adjustable to accommodate laptop computers and similar portable electronic products having various widths. There exists yet another specific need for such an anti-theft device that includes a lock mechanism operable for automatically locking the anti-theft device and a magnetic key operable for unlocking the anti-theft device.

BRIEF SUMMARY OF THE INVENTION

The aforementioned needs, objectives and advantages, as well as others readily apparent to those of ordinary skill in the art, are provided by an anti-theft device for protecting a laptop computer or similar portable electronic product from theft or unauthorized removal. In a preferred embodiment, an anti-theft device according to the invention is configured to protect a laptop computer or similar portable electronic product having a base portion and a cover portion attached to the base portion with the cover portion extending from the base portion at an angle. In another preferred embodiment, an anti-theft device according to the invention is adjustable to accommodate laptop computers and similar portable electronic products having various widths. In yet another preferred embodiment, an anti-theft device according to the invention includes a lock mechanism operable for automatically locking the anti-theft device and a magnetic key operable for unlocking the anti-theft device.

In one aspect, the invention is embodied by an anti-theft device for protecting an item from theft or unauthorized removal. The anti-theft device includes at least one retaining assembly including a retaining arm terminating in a retaining hook for engaging a lateral edge of the item. The retaining arm is configured to be adjustable to accommodate items having various widths. The anti-theft device further includes a lock mechanism for locking the retaining arm in a locked configuration wherein the item cannot be removed from the anti-theft device. In a particularly advantageous embodiment, at least one retaining assembly includes a retaining base and the retaining arm comprises at least one retaining leg depending from the retaining arm that is received within the retaining base in the locked configuration.

In another aspect, the invention is embodied by an anti-theft device for protecting an item from theft or unauthorized removal including at least one retaining assembly having a laterally extending retaining arm for engaging a lateral edge of the item in a locked configuration. The anti-theft device further includes a means for adjusting a lateral location of the retaining arm to accommodate items having various widths. The anti-theft device further includes a means for positioning and locking the retaining arm of the anti-theft device onto the item in a locked configuration. The anti-theft device further includes a means for unlocking the retaining arm of the anti-theft device from the locked configuration to an unlocked configuration to thereby remove the item from the anti-theft device.

In yet another embodiment, the invention is embodied by an anti-theft device for protecting a laptop computer or similar portable electronic product from theft or unauthorized removal. The anti-theft device includes at least one retaining assembly including a laterally extending retaining arm. The retaining arm terminating in a retaining hook for engaging a lateral edge of the laptop computer or similar portable electronic product and having a retaining leg depending therefrom. The retaining assembly further includes a retaining base configured for receiving the retaining leg of the retaining arm in a locked configuration. The retaining arm is configured to be adjustable to a desired lateral location to accommodate laptop computers or similar portable electronic products having various widths. The anti-theft device further includes a lock mechanism comprising a shuttle fixed to a collar made of a magnetically attractive material and a biasing spring for biasing the shuttle into engagement with the retaining leg of the retaining arm. The lock mechanism is configured to be operable with a magnetic key that imparts a magnetic attraction force to the shuttle against a biasing force of the biasing spring. The magnetic attraction force moves the shuttle out of engagement with the retaining leg of the retaining arm to unlock the retaining arm from the retaining base and thereby permit the retaining arm to move to an unlocked configuration wherein the laptop computer or similar portable electronic product may be removed from the anti-theft device.

BRIEF DESCRIPTION OF THE DRAWINGS

The present invention is best understood by reference to the following detailed description taken in conjunction with the accompanying drawing figures in which.

DETAILED DESCRIPTION OF EMBODIMENTS OF THE INVENTION

Figure 1:
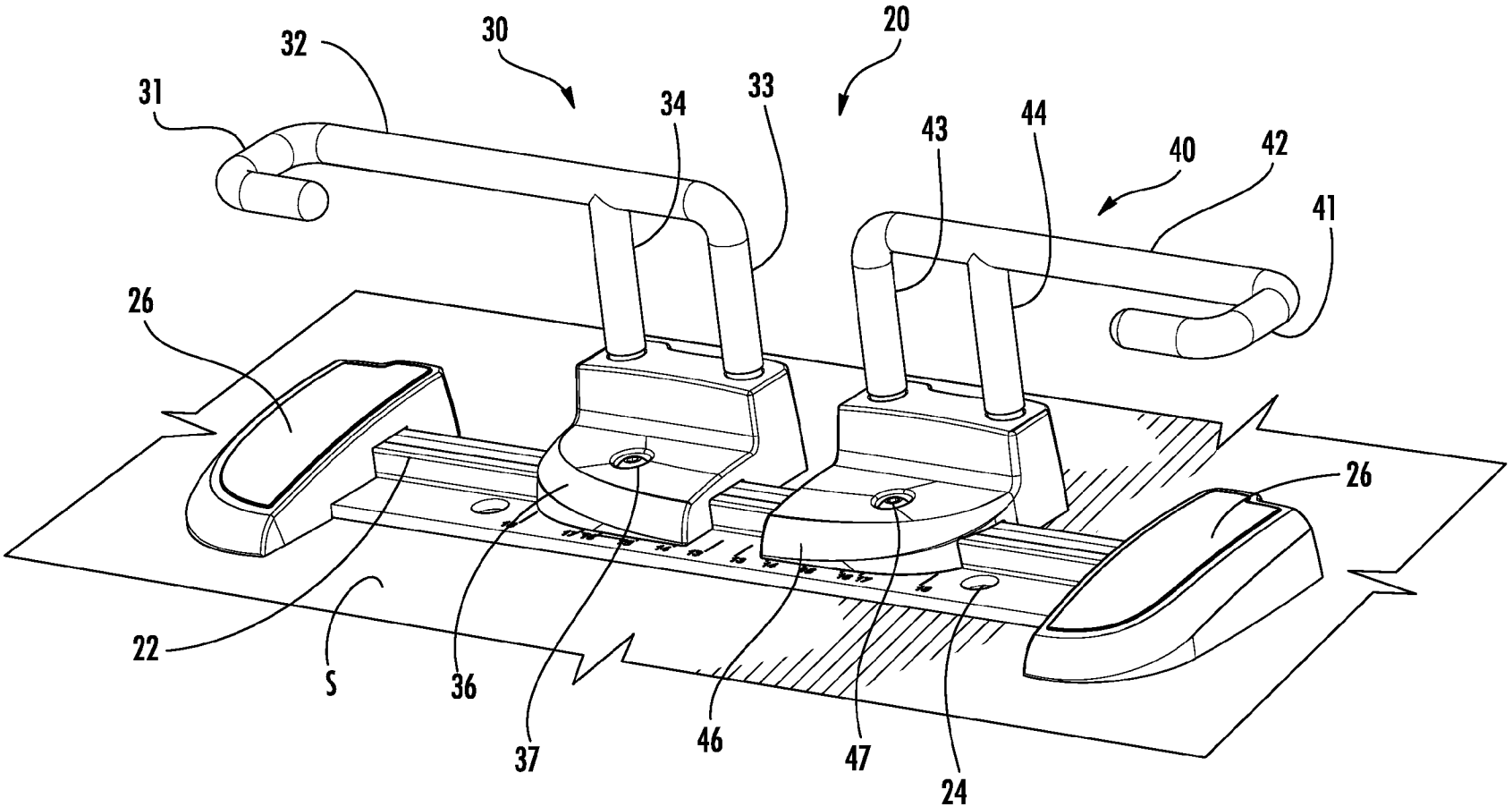
FIG. 1 is a front perspective view showing an exemplary embodiment of an anti-theft device for protecting a laptop computer or similar portable electronic product in accordance with the present invention.

Reference will now be made to the accompanying drawing figures wherein identical reference numerals denote the same or similar elements throughout the various views. FIGS. 1-11 show an exemplary embodiment of an anti-theft device, indicated generally by reference character 20 in various figures, for protecting a laptop computer or similar portable electronic product, indicated generally by reference character L in various figures, against theft or unauthorized removal. FIGS. 12-17 show another embodiment of an anti-theft device, indicated generally by reference character 120 in various figures, which is likewise operable for protecting a laptop computer or similar portable electronic product L against theft or unauthorized removal. As used herein, the term "laptop computer" is intended to include without limitation all types of portable, personal computers, for example notebook, mini-notebook, sub-notebook and netbook type computers, as well as personal data assistant (PDA) type devices. The term "similar portable electronic product" is intended to include without limitation any type of portable personal education and/or entertainment device, for example a digital video disc (DVD) player, karaoke machine, and the like. The exemplary embodiment of the anti-theft device 20 shown in FIGS. 1-11 is especially suitable for use with standard-sized laptop computers (e.g. notebook) and relatively wide portable electronic products (e.g. widescreen DVD player). Conversely, the exemplary embodiment of the anti-theft device 120 shown in FIGS. 12-17 is especially suitable for use with smaller-sized laptop computers (e.g. netbook) and relatively narrow portable electronic products (e.g. small screen DVD player; PDA).

In either case, the laptop computer or similar portable electronic product to be protected by the anti-theft device 20, 120 has a base portion B and a cover portion C attached to the base portion with the cover portion extending from the base portion at an angle, indicated generally by the reference character A in various figures. Typically, the cover portion C is movably attached to the base portion B, for example by one or more hinges or equivalent structure, such that the cover portion C is movable relative to the base portion B between a closed position and an opened position. In most instances, the cover portion C comprises a display screen and is movable from the closed position to any one of several opened positions through the angle A so that a user may position the display screen at a convenient viewing location. Generally, anti-theft devices according to the present invention engage the cover portion C of the laptop computer or similar portable electronic product in a locked configuration with the base portion B irremovably disposed between the anti-theft device and a support surface S in a convenient display or use position. Furthermore, the anti-theft device loosely engages the cover portion C so that the angle A of the display screen relative to the base portion B can be adjusted to the convenient viewing location and, at the same time, the base portion B is free to move in an upward direction off the support surface S so that a user may experience the weight of the laptop computer or similar portable electronic product L. However, as will be explained in greater detail with respect to FIGS. 9-11, the anti-theft device protects the laptop computer or similar portable electronic product against theft or unauthorized removal regardless of the angle A defined between the base portion B and the cover portion C, or the position of the base portion B relative to the support surface S.

As best shown in FIG. 1, the anti-theft device 20 comprises a rail 22 configured for attachment to the support surface S. The rail 22 may be attached to the support surface S by any suitable means, for example by pressure sensitive adhesive (PSA), such as double-sided tape, or by suitable fasteners extending through corresponding openings 24 formed in the rail 22 and into the support surface S. Rail 22 is operable for adjustably receiving and aligning a pair of retaining assemblies 30, 40, as will be described. One or more end caps 26 may be provided to aesthetically complete the opposed ends of the rail 22 and to support the base portion B of a laptop computer or similar portable electronic product slightly above and out of contact with the rail 22 and the lower portions of the retaining assemblies 30, 40. As will be readily apparent to those skilled in the art, rail 22 may be extended in a lengthwise direction and one or more additional end caps 26 may be provided to support additional laptop computers or similar portable electronic products in a desired orientation for display and/or use. Support surface S may be any surface suitable for receiving and securing the anti-theft device 20, but preferably is a generally flat surface of a relatively immovable object, such as a desk, table top, display counter, wall, floor, or the like.

Retaining assembly 30 comprises a laterally extending retaining arm 32 terminating at an outer end in a retaining hook 31. As shown, retaining hook 31 is generally L-shaped. However, retaining hook 31 may have any shape (e.g. U-shaped; V-shaped) suitable for retaining a lateral edge of a laptop computer or similar portable electronic product, in the manner shown in FIG. 3. Retaining assembly 30 further comprises an inner retaining leg 33 and an outer retaining leg 34. Retaining legs 33, 34 are each received within a corresponding opening formed in a retaining base 36 that is configured to engage rail 22 such that the retaining assembly 30 is positionable (i.e. slidable) along the rail in the lengthwise direction. Retaining assembly 30, and more particularly the retaining base 36, is secured to the rail 22 at a desired lateral position by a fastener 37 having a proprietary head so as to discourage theft of the laptop computer or similar portable electronic product, as will be described with reference to FIGS. 4-5. Alternatively, fastener 37 may be any common fastener suitable for use with anti-theft devices that do not require enhanced security. As shown, retaining legs 33, 34 are permanently fixed within the openings formed in retaining base 36, or alternatively, are integrally formed with the retaining base. However, retaining legs 33, 34 (and consequently retaining arm 32) may be removably disposed within the retaining base 36, as will be described with reference to retaining assembly 40.

Retaining assembly 40 likewise comprises a laterally extending retaining arm 42 terminating at an outer end in a retaining hook 41. As shown, retaining hook 41 has the same configuration as retaining hook 31. However, the size and/or shape of the retaining hook 41 may be the same or different than the size and/or shape of the retaining hook 31 without departing from the invention. Regardless, retaining hook 41 engages the lateral edge of the laptop computer or similar portable electronic product opposite the lateral edge engaged by retaining hook 31, in the manner shown in FIG. 3. As used herein, the term "engages" is intended to include retaining hooks that remain in sufficiently close proximity to the lateral edges of the laptop computer or similar portable electronic product to prevent the display screen to be moved (e.g. twisted or rotated) out of confinement with the anti-theft device. Retaining assembly 40 further comprises an inner retaining leg 43 and an outer retaining leg 44. Retaining legs 43, 44 are each received within a corresponding opening formed in a retaining base 46 that is configured to engage rail 22 such that the retaining assembly 40 is positionable (i.e. slidable) along the rail in the lengthwise direction in the same manner as retaining assembly 30. Retaining assembly 40, and more particularly the retaining base 46, is secured to the rail 22 at a desired lateral position by a fastener 47 having a proprietary head, as will be described with reference to FIGS. 4-5, so as to discourage theft of the laptop computer or similar portable electronic product. Alternatively, fastener 47 may be any common fastener suitable for use with anti-theft devices that do not require enhanced security. As will be described with reference to FIG. 2, retaining legs 43, 44 are removably disposed within the openings formed in retaining base 46 so that the retaining arm 42 of the anti-theft device 20 may be positioned and locked onto the laptop computer or similar portable electronic product in a locked configuration, and then subsequently unlocked from the locked configuration to permit the laptop computer or similar portable electronic product to be removed from the anti-theft device 20, as will be described with reference to FIG. 6.

Figure 2:
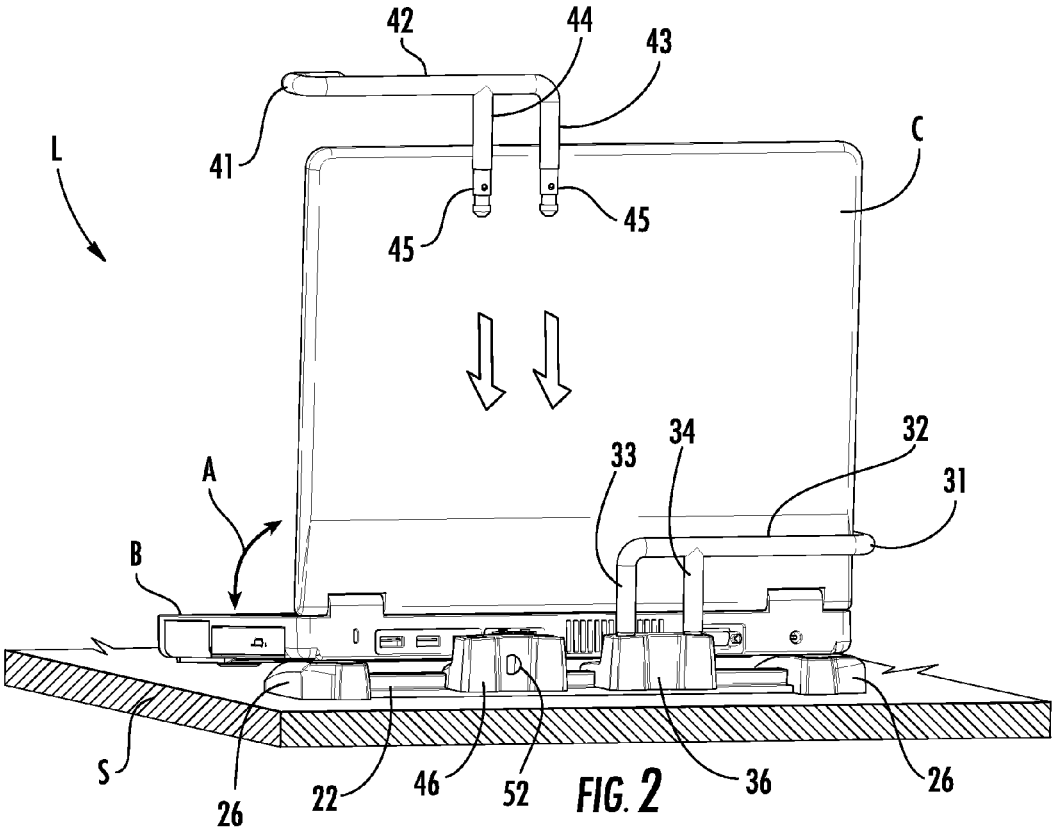
FIG. 2 is a rear perspective view illustrating an exemplary means for positioning and automatically locking the anti-theft device of FIG. 1 onto a laptop computer in accordance with the present invention.
Figure 3:
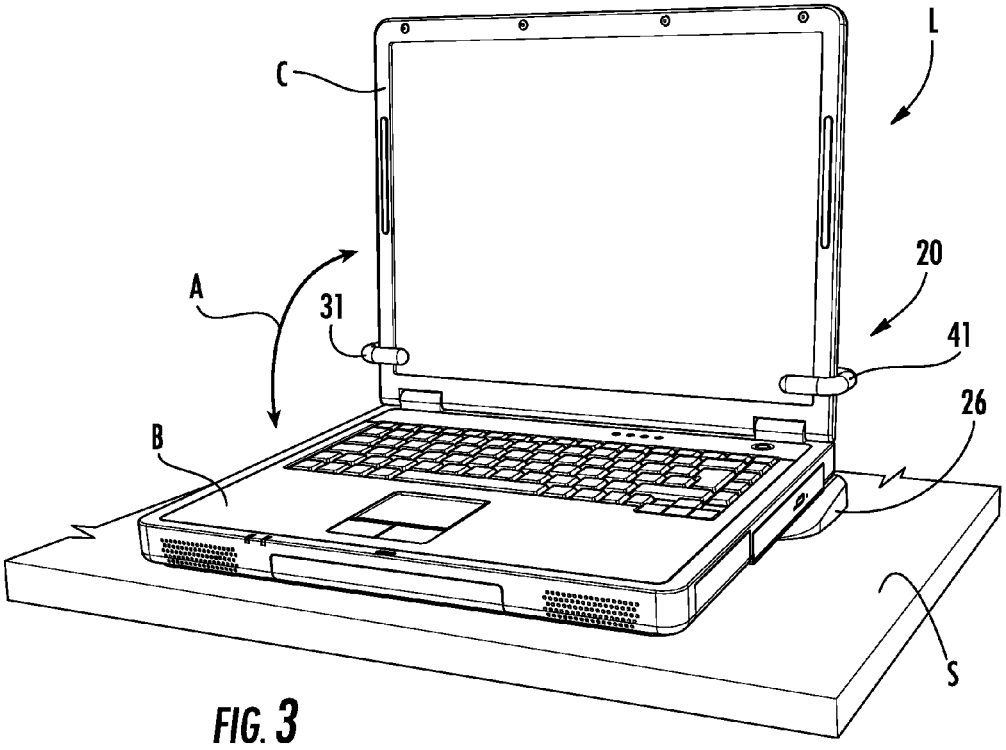
FIG. 3 is a front perspective view showing the anti-theft device of FIG. 1 positioned and locked onto the laptop computer of FIG. 2 in a locked configuration.

FIG. 2 illustrates an exemplary means for positioning and automatically locking the anti-theft device 20 onto a laptop computer L in a locked configuration. FIG. 3 shows the anti-theft device 20 positioned and locked onto the laptop computer L in the locked configuration. As previously mentioned, retaining arm 32 of retaining assembly 30 is typically permanently fixed to retaining base 36 in the position shown herein. Accordingly, the base portion B of the laptop computer L can be positioned on the anti-theft device 20, and more specifically on the end caps 26, with the cover portion C disposed at an angle A relative to the base portion B and with a lateral edge of the cover portion C engaged (as defined herein) by the retaining hook 31. In particular, the lateral edge of the cover portion C of the laptop computer L is disposed in a confined manner between the retaining arm 32 and the retaining hook 31 of the retaining assembly 30. The retaining arm 42 of the retaining assembly 40 is then located above the cover portion C of the laptop computer L and moved downwardly in the direction indicated by the arrows in FIG. 2 so that the retaining legs 43, 44 are received within the retaining base 46 with the opposite lateral edge of the cover portion C disposed in a confined manner between the retaining arm 42 and the retaining hook 41. Alternatively, retaining arm 42 may be located adjacent the cover portion C of the laptop computer L and first moved inwardly in the direction of the retaining assembly 30 so that the opposite lateral edge of cover portion C is disposed between the retaining arm 42 and the retaining hook 41, and then moved downwardly as previously described. Regardless, at least one of the retaining legs 43, 44, and preferably as shown herein both of the retaining legs 43, 44, comprises a resilient or flexible foot 45. Each foot 45 operates to guide the retaining legs 43, 44 into the openings formed in the retaining base 46 and to properly seat the retaining arm 42 within the retaining base 46, as will be described with reference to FIG. 7. Each foot 45 further operates to lock the retaining arm 42 into the retaining base 46 of the retaining assembly 40, as will likewise be described with reference to FIG. 7. As best shown in FIG. 2, a recess 52 is formed on an exterior surface of the retaining base 46 for receiving a key to unlock the retaining arm 42 from the retaining base 46, as will be described with reference to FIG. 8.

Figure 4:
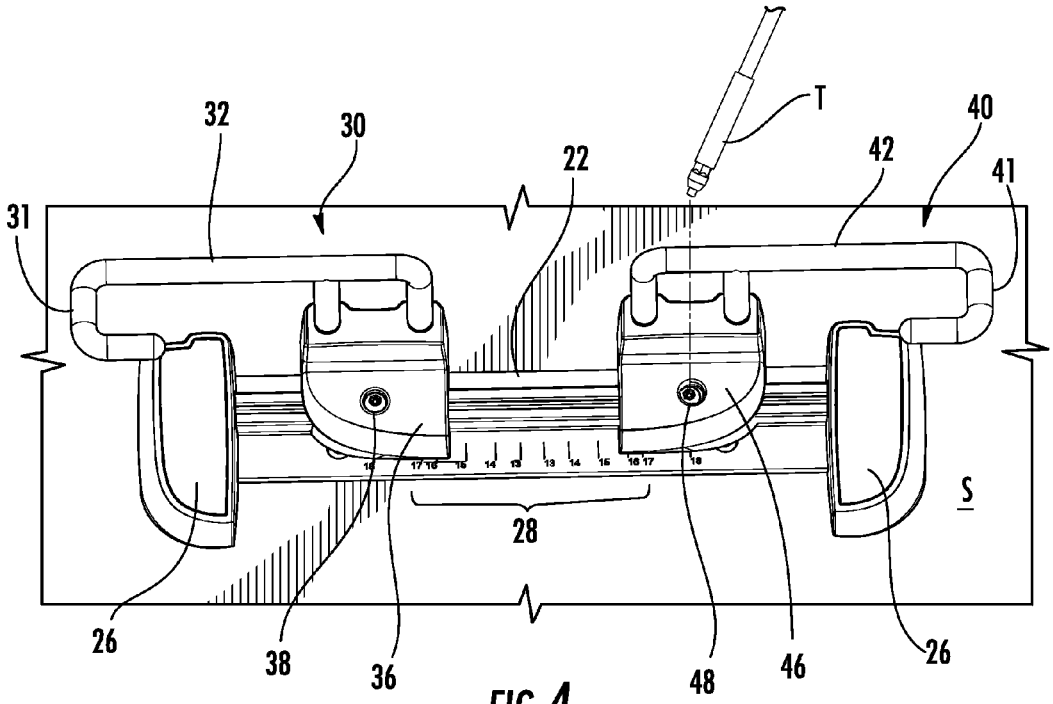
FIGS. 4-5 are each a top perspective view illustrating an exemplary means for adjusting the anti-theft device of FIG. 1 to accommodate laptop computers or similar portable electronic products having various widths in accordance with the present invention.
Figure 5:
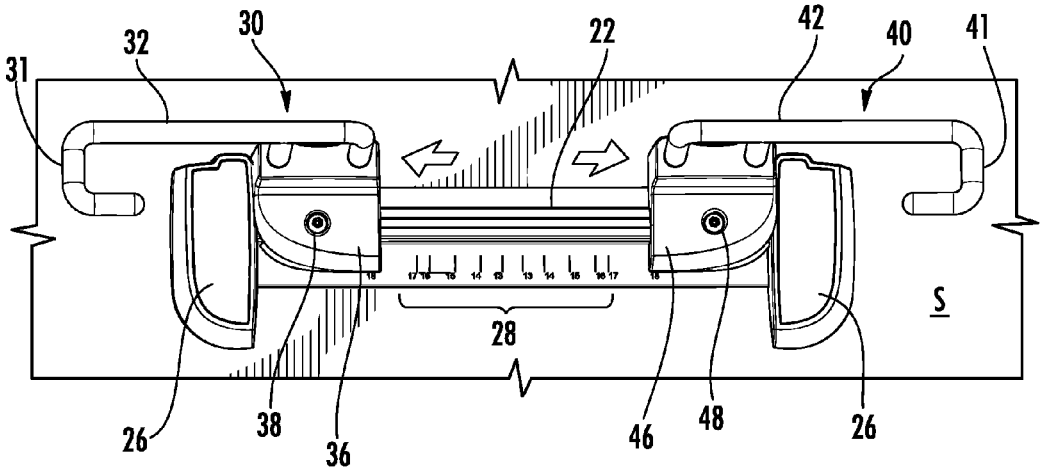

FIGS. 4-5 illustrate an exemplary means for adjusting the anti-theft device 20 to accommodate laptop computers or similar portable electronic products having various widths. As previously mentioned, retaining assembly 30 and retaining assembly 40 are each independently movable (i.e. slidable) along the rail 22 in the lengthwise direction. As shown, retaining base 36 of retaining assembly 30 has an opening 38 formed therethrough for receiving the proprietary fastener 37 to secure the retaining assembly 30 at a desired lateral location along the rail 22. Likewise, retaining base 46 of retaining assembly 40 has an opening 48 formed therethrough for receiving the proprietary fastener 47 to secure the retaining assembly 40 at a desired lateral location along the rail 22. As illustrated in FIG. 4, a proprietary tool T is used to loosen one or both of the fasteners 37, 47 so that the corresponding retaining base 36, 46 can be repositioned to another lengthwise location along the rail 22 at which the retaining hooks 31, 41 will properly engage (as defined herein) the lateral edges of a laptop computer or similar portable electronic product. If desired, the rail 22 may be provided with printed indicia, such as graduated scale 28, for assisting an operator to properly position the retaining base 36, 46 at the desired lateral location in a known manner. As illustrated in FIG. 5, with fasteners 37, 47 loosened retaining assembly 30 and/or retaining assembly 40 can then be moved outwardly as indicated by the arrows to accommodate a laptop computer or similar portable electronic product having a greater width. The fasteners 37, 47 are then tightened again using the tool T to secure retaining assembly 30 and/or retaining assembly 40 at the desired lateral location along the rail 22. As will be readily apparent to one of ordinary skill, either one or both of the retaining assemblies 30, 40 may be repositioned in either lengthwise direction to accommodate laptop computers and similar portable electronic products having various widths.

Figure 6:
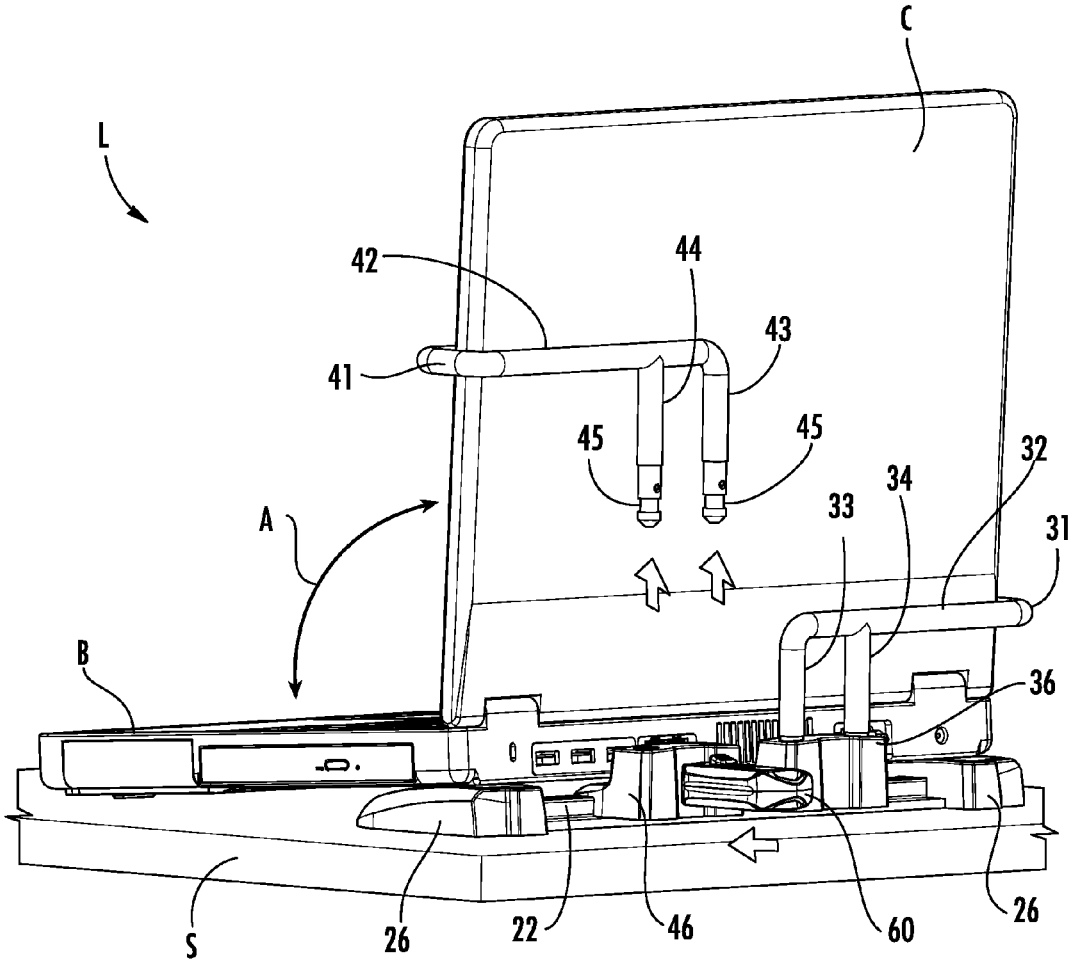
FIG. 6 is a rear perspective view illustrating an exemplary means for unlocking the anti-theft device of FIG. 1 from the locked configuration using a magnetic key in accordance with the present invention.

FIG. 6 illustrates an exemplary means for unlocking the anti-theft device 20 from the locked configuration using a magnetic key 60. The magnetic key 60 may be any device suitable for engaging a corresponding lock mechanism disposed within the retaining base 46 of the retaining assembly 40, as will be described with reference to FIGS. 7-8. As shown, magnetic key 60 is functionally equivalent to the magnetic key shown and described in U.S. application Ser. No. 11/968,680 filed on Jan. 3, 2008, and published as United States Patent Application Publication No. 2008/0168811, which is assigned to the assignee of the present invention. The magnetic key 60 operates to release the foot 45 of each of the retaining legs 43, 44, and thereby permit the retaining arm 42 to be moved upwardly in the direction indicated by the arrows in FIG. 6 and removed from the retaining base 46 of the retaining assembly 40. Once the retaining arm 42 is free of the retaining base 46, the laptop computer L can be moved out of engagement with the retaining hooks 31, 41 and off of the end caps 26 of the anti-theft device 20. As will be readily apparent to one of ordinary skill in the art, either or both of the retaining assemblies 30, 40 (and more specifically retaining base 36 and/or retaining base 46) may be provided with a lock mechanism that is operated by a magnetic key 60 as described herein without departing from the invention. Furthermore, either or both of the retaining assemblies 30, 40 may be provided with an alternative type of lock mechanism and a corresponding key for unlocking the anti-theft device 20 to permit removal of a laptop computer or similar portable electronic product without departing from the invention.

Figure 7:
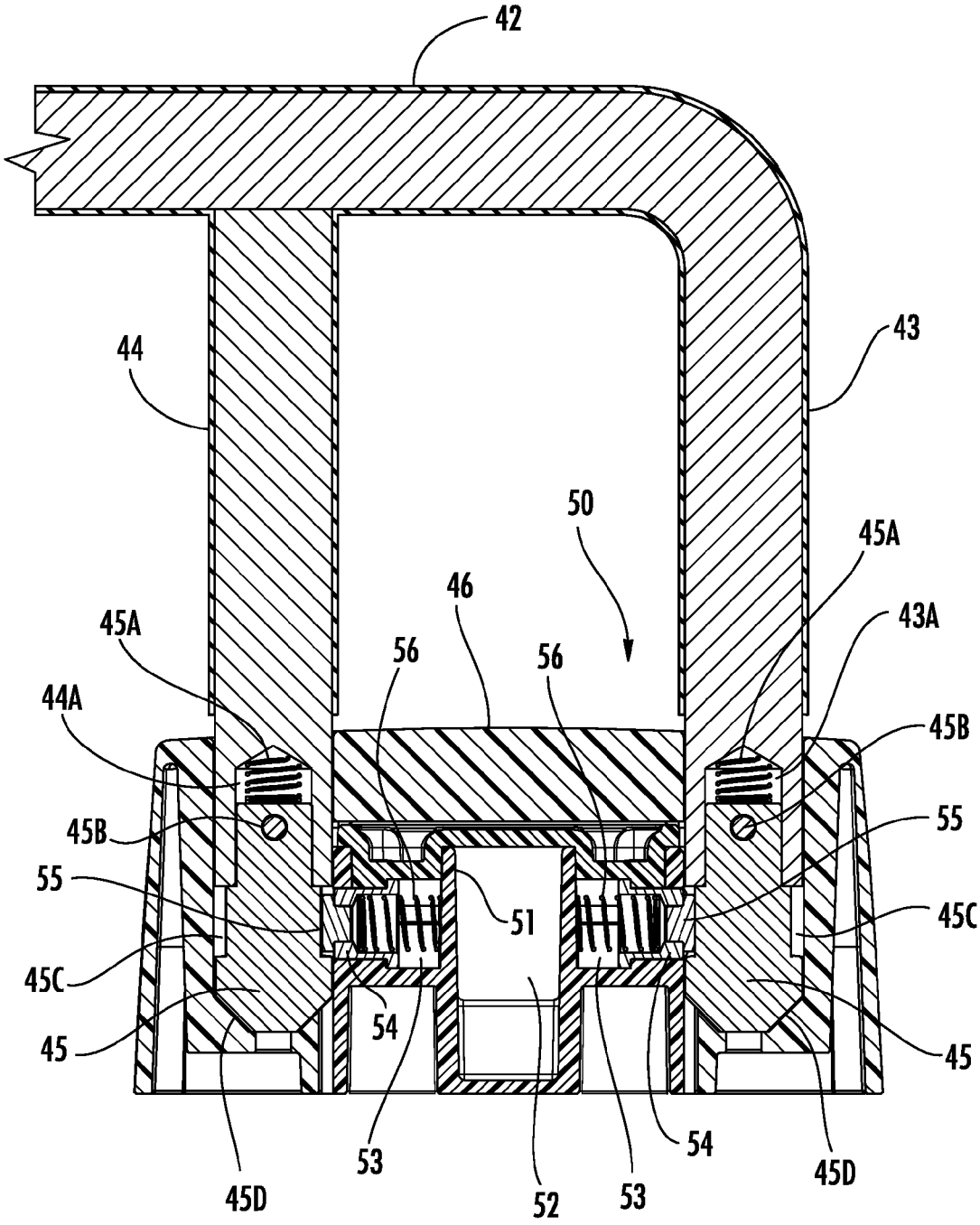
FIG. 7 is a detailed section view showing an exemplary embodiment of a lock mechanism of the anti-theft device of FIG. 1 in a locked configuration in accordance with the present invention.
Figure 8:
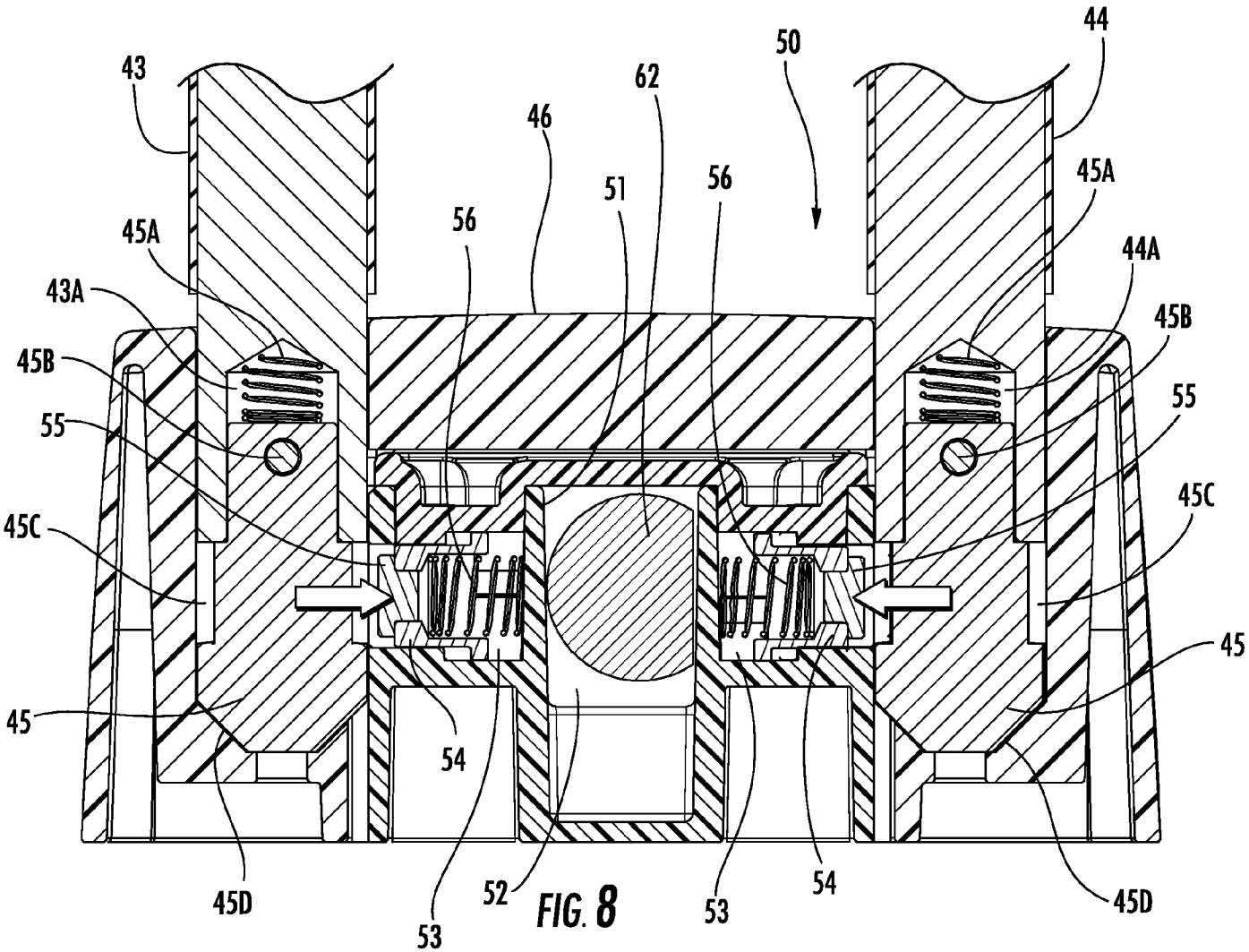
FIG. 8 is a detailed section view showing the lock mechanism of FIG. 7 with the magnetic key of FIG. 6 inserted therein and the lock mechanism in an unlocked configuration.

FIG. 7 shows an exemplary embodiment of a lock mechanism 50 of the anti-theft device 20 with the lock mechanism in a locked configuration. FIG. 8 shows the lock mechanism 50 with the magnetic key 60 described with reference to FIG. 6 inserted therein and the lock mechanism in an unlocked configuration. As shown, lock mechanism 50 comprises a housing 51 that defines an interior cavity in communication with the recess 52 formed in the retaining base 46 of retaining assembly 40. Housing 51 further defines at least one, and preferably as shown herein, a pair of laterally extending internal chambers 53. Each chamber 53 contains a collar 54 and a shuttle 55 that is fixed to the collar and biased outwardly away from the cavity/recess 52 by a biasing spring 56. The collar 54 is made of a magnetically attractive material so as to be attracted inwardly from the locked configuration to the unlocked configuration in the direction indicated by the arrows in FIG. 8 when a magnetic probe 62 of the magnetic key 60 is inserted into the cavity/recess 52. More specifically, the magnetic attraction force imparted by the magnetic probe 62 overcomes the biasing force exerted by each biasing spring 56 against the corresponding shuttle 55 and thereby moves the shuttle out of engagement with one or both of the retaining legs 43, 44, as will be described.

As shown herein, the upper end of resilient foot 45 is disposed within a hollow lower portion 43A, 44A of the corresponding retaining leg 43, 44 and extends outwardly (i.e. downwardly) from the retaining leg. The foot 45 comprises a biasing spring 45A that biases the foot away from the retaining leg 43, 44. In addition, the foot 45 is pivotally connected to the lower portion 43A, 44A of the retaining leg 43, 44 by a pivot pin 45B. Accordingly, the biasing spring 45A and the pivot pin 45B cooperate to permit the foot 45 to seat properly within the opening provided in the retaining base 46. In particular, the foot 45 is resiliently, or flexibly, connected to the retaining leg 43, 44 so that the foot 45 will "bottom out" in the retaining base 46 and an undercut portion 45C located medially on the foot will be aligned with the corresponding shuttle 55 of the lock mechanism 50. Thus, the shuttle 55 will seat within the undercut portion 45C and beneath the bottom of the lower portion 43A, 43B of the corresponding retaining leg 43, 44 in the locked configuration (FIG. 7). The resiliency or flexibility of the foot 45 relative to the retaining leg 43, 44 accounts for the potential build-up of manufacturing and assembly tolerances that could cause the foot 45 to "bottom out" within the retaining base 46 without the shuttle 55 being fully engaged within the undercut portion 45C, and therefore, the retaining arm 42 not being securely locked into the retaining base. This feature further functions to accommodate laptop computers and similar portable electronic products having a relatively thick base portion B and provides compliance to prevent a retaining leg 43, 44 that has been locked from being unable to be unlocked. If desired, the foot 45 may also be provided with a chamfer 45D adjacent the lower end to assist in guiding and centering the retaining leg 43, 44 into the corresponding opening formed in the retaining base 46. It should be noted that the use of the two retaining legs 43, 44 in conjunction with the "dual" lock mechanism 50 comprising a pair of spring-biased shuttles 55 provides additional mechanical strength, particularly against a torsional force and/or bending moment, as well as redundancy, while still permitting the retaining arm 42 to be unlocked from the retaining base 46 by a single action of the magnetic key 60. However, it is anticipated that under certain circumstances redundancy will not be required and a single retaining leg and a lock mechanism 50 comprising a single spring-biased shuttle 55 will provide sufficient structural integrity. Conversely, under other circumstances it may be desirable to provide both retaining assemblies 30, 40 of the anti-theft device 20 with a pair of retaining legs, as previously mentioned, and a dual lock mechanism 50.

Figure 9:
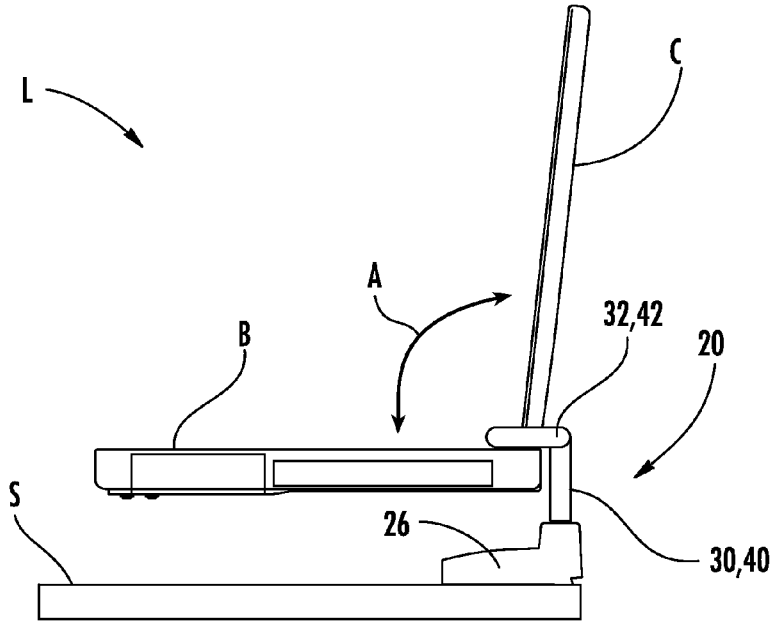
FIGS. 9-11 are each a side view showing the anti-theft device of FIG. 1 locked onto a laptop computer and operable for preventing the laptop computer from being removed by an unauthorized person.
Figure 10:
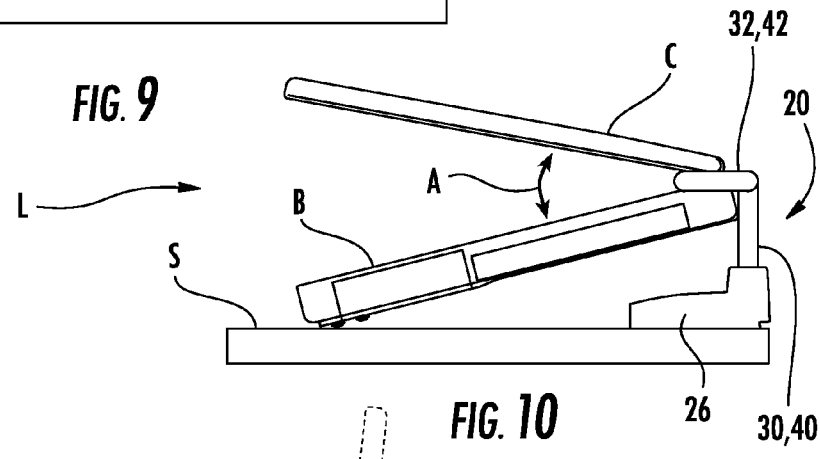
Figure 11:
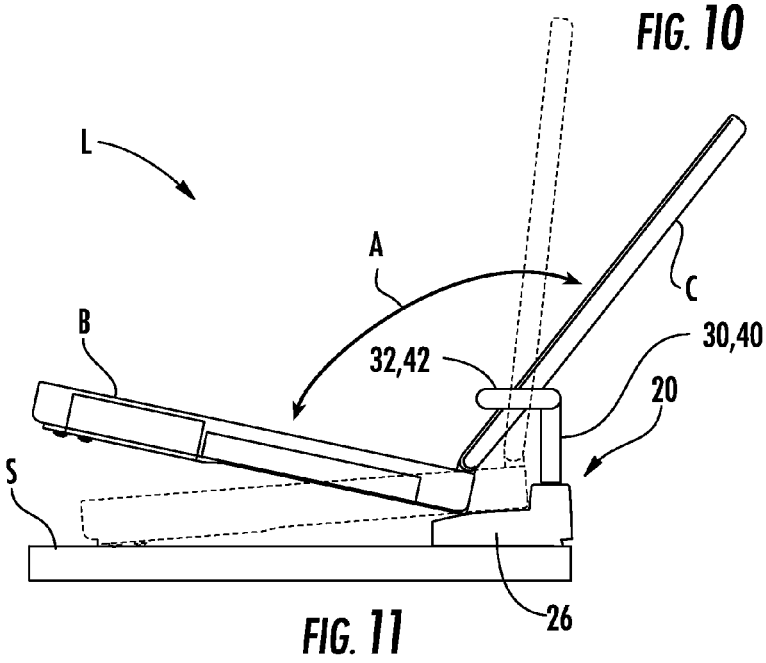

FIGS. 9-11 show the anti-theft device 20 locked onto a laptop computer L and operable for preventing the laptop computer L from being removed by an unauthorized person. The anti-theft device 20 permits the cover portion C of the laptop computer L to be positioned at nearly any angle A relative to the base portion B, while still preventing the laptop computer L from being removed without first unlocking the anti-theft device. Furthermore, as illustrated in FIG. 9, the anti-theft device 20 permits the laptop computer L to be lifted upwardly off the end caps 26 and the support surface S in the locked configuration. In this manner, a potential purchaser is able to experience the weight of the laptop computer L before actually purchasing it. As illustrated in FIG. 10, the vertical location of the retaining arms 32, 42 of the retaining assemblies 30, 40 relative to the support surface S prevent a potential thief from lifting the rear end of the laptop computer L sufficiently to remove it with the cover portion C substantially closed (i.e. with angle A being less than about thirty degrees). As illustrated in FIG. 11, the vertical location of the retaining arms 32, 42 of the retaining assemblies 30, 40 relative to the end caps 26 of the anti-theft device 20 prevent a potential thief from lifting the forward end of the laptop computer L sufficiently to remove it with the cover portion C substantially opened (i.e. with angle A being greater than about one hundred twenty degrees).

Figure 12:
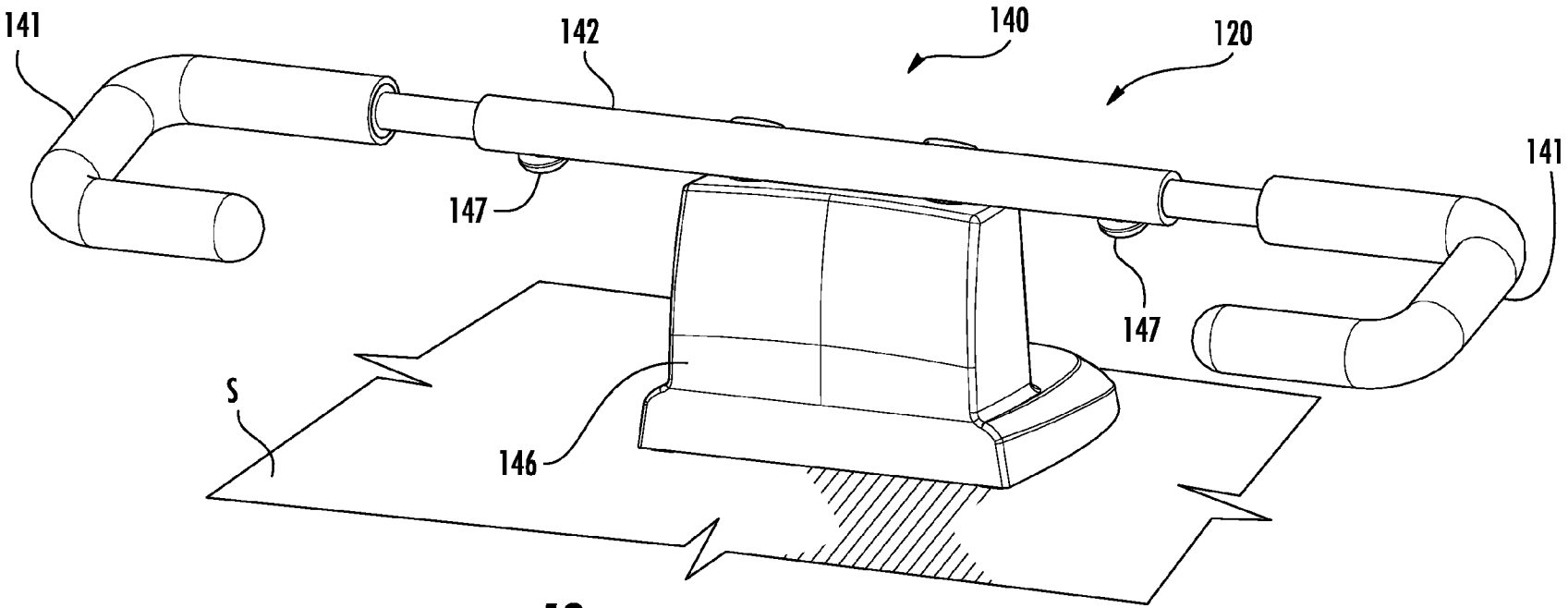
FIG. 12 is a front perspective view showing another exemplary embodiment of an anti-theft device for protecting a laptop computer or similar portable electronic product in accordance with the present invention.

FIGS. 12-17 show the anti-theft device 120 for protecting a laptop computer or similar portable electronic product. The anti-theft device 120 is similar in many respects to the anti-theft device 20 previously described, and therefore, only the significant differences between the anti-theft device 20 and the anti-theft device 120 will be discussed in further detail. As best shown in FIG. 12, the anti-theft device 120 comprises a single retaining assembly 140 comprising a single laterally extending retaining arm 142. Retaining arm 142, however, is constructed in the form of a generally hollow tube having an opening at each end for receiving a retaining hook 141. Each retaining hook 141 is generally U-shaped for engaging (as defined herein) a lateral edge of a laptop computer or similar portable electronic product in the manner previously described. The retaining hook 141 further comprises a stud, post, or the like at its inner end configured to be received within the corresponding opening of the retaining arm 142. As one of ordinary skill will readily appreciate, the retaining hook 141 may alternatively be hollow and the retaining arm 142 fitted with a stud, post or the like configured to be received within the corresponding opening of the retaining hook.

Figure 13:
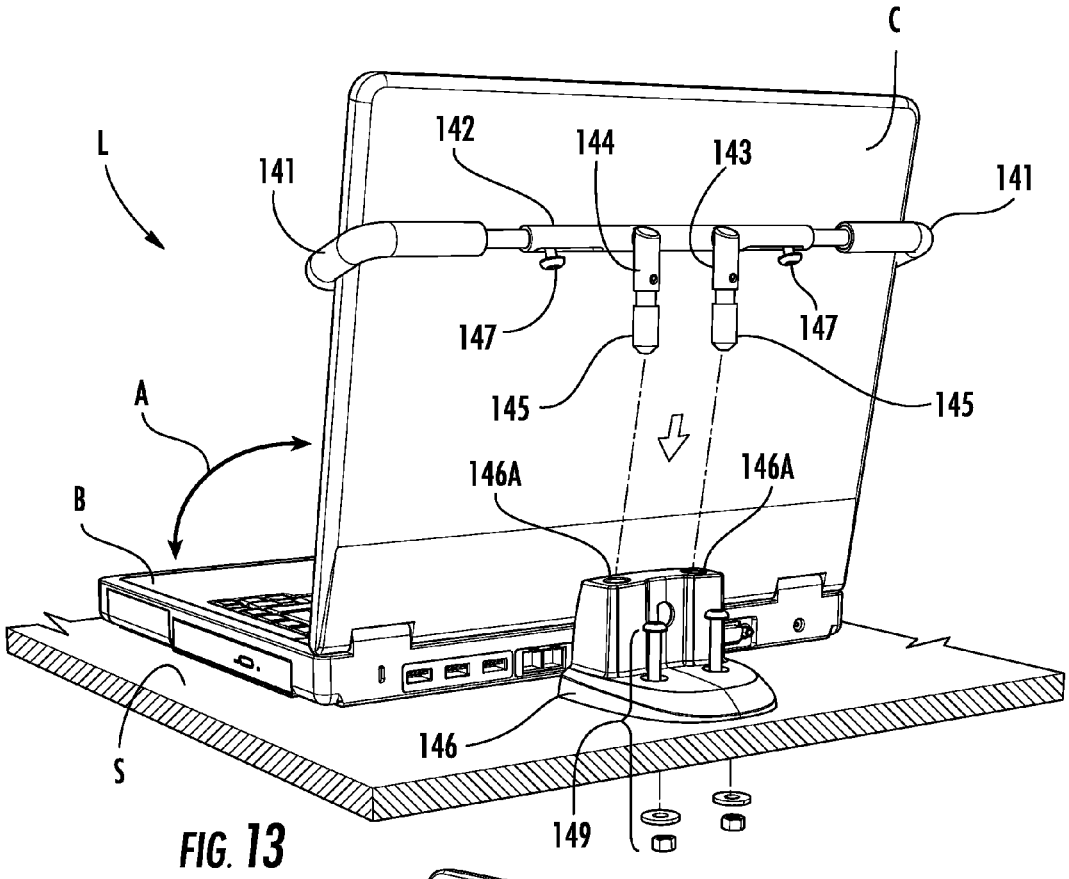
FIG. 13 is a rear perspective view illustrating another exemplary means for positioning and automatically locking the anti-theft device of FIG. 12 onto a laptop computer in accordance with the present invention.

As best shown in FIG. 13, the retaining assembly 140 further comprises a retaining base 146 having at least one, and preferably as shown, a pair of openings 146A formed in the retaining base. The openings 146A each receive a resilient or flexible foot 145 of a retaining leg 143, 144 depending from the retaining arm 142 in the manner previously described. Each foot 145 operates in the manner previously described to guide and seat the retaining leg 143, 144 within the retaining base 146. It should be noted that the retaining assembly 140 may comprise only a single retaining leg with or without the resilient or flexible foot 145 without departing from the invention. However, the use of two retaining legs 143, 144 each having a resilient or flexible foot 145 is preferred for the purposes of providing additional mechanical strength and redundancy, and to account for manufacturing and assembly tolerances. The retaining base 146 may be secured to the support surface S by any suitable means, for example by pressure sensitive adhesive (PSA), such as double-sided tape, one or more common fasteners, or as shown by one or more fasteners 149 having a proprietary head requiring a corresponding proprietary tool T (FIG. 16), as previously described.

Figure 14:
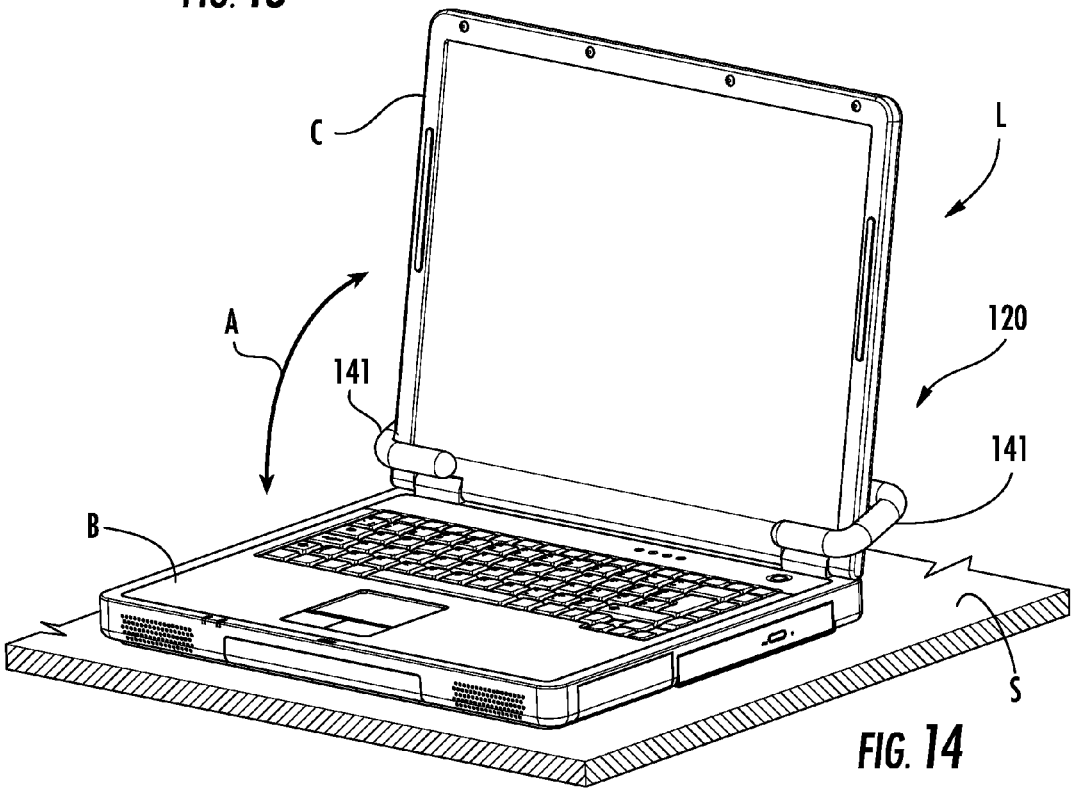
FIG. 14 is a front perspective view showing the anti-theft device of FIG. 12 positioned and locked onto the laptop computer of FIG. 13 in a locked configuration.
Figure 15:
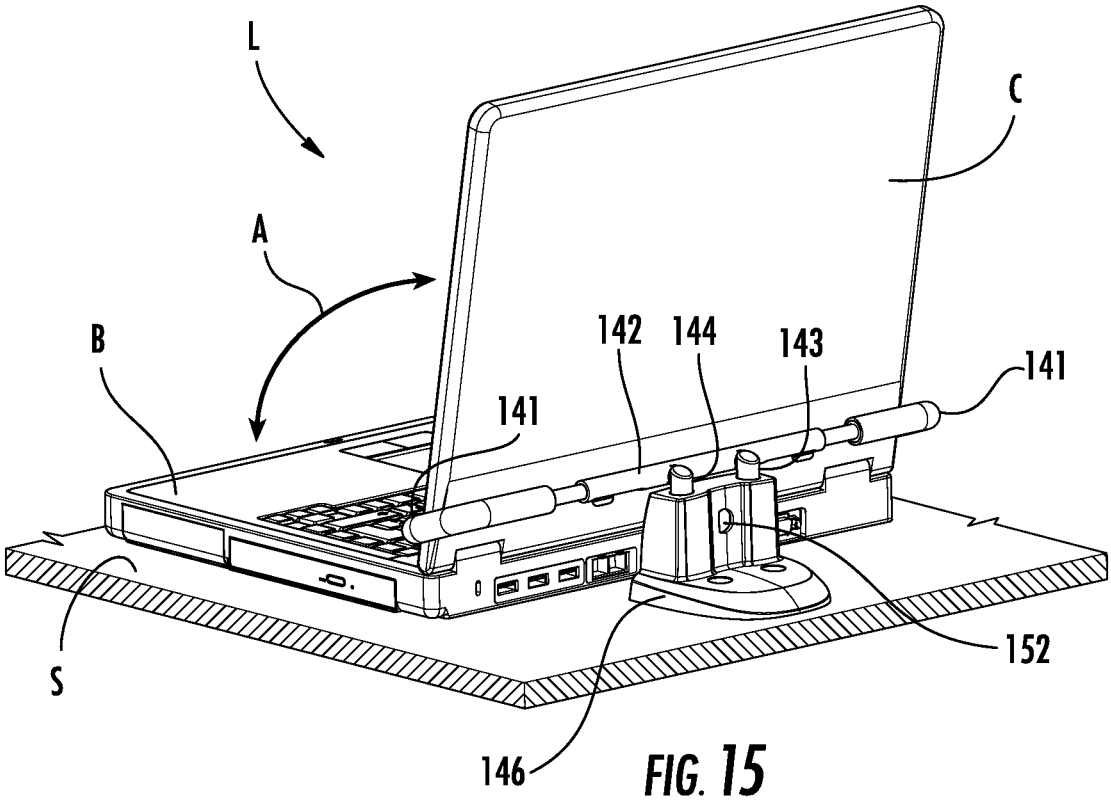
FIG. 15 is a rear perspective view showing the anti-theft device of FIG. 12 positioned and locked onto the laptop computer of FIG. 13 in the locked configuration.

FIG. 13 illustrates another exemplary means for positioning and automatically locking the anti-theft device 120 onto a laptop computer L. The retaining arm 142 is positioned over the cover portion C of the laptop computer L and moved downwardly in the direction indicated by the arrows in FIG. 13 until the retaining legs 143, 144 of the retaining assembly 140 are disposed within the openings 146A of the retaining base 146 with each foot 145 seated therein in a locked configuration, as previously described. FIG. 14 shows the anti-theft device 120 positioned and locked onto the laptop computer L in the locked configuration from the front, while FIG. 15 shows the anti-theft device 120 positioned and locked onto the laptop computer L in the locked configuration from the rear.

Figure 16:
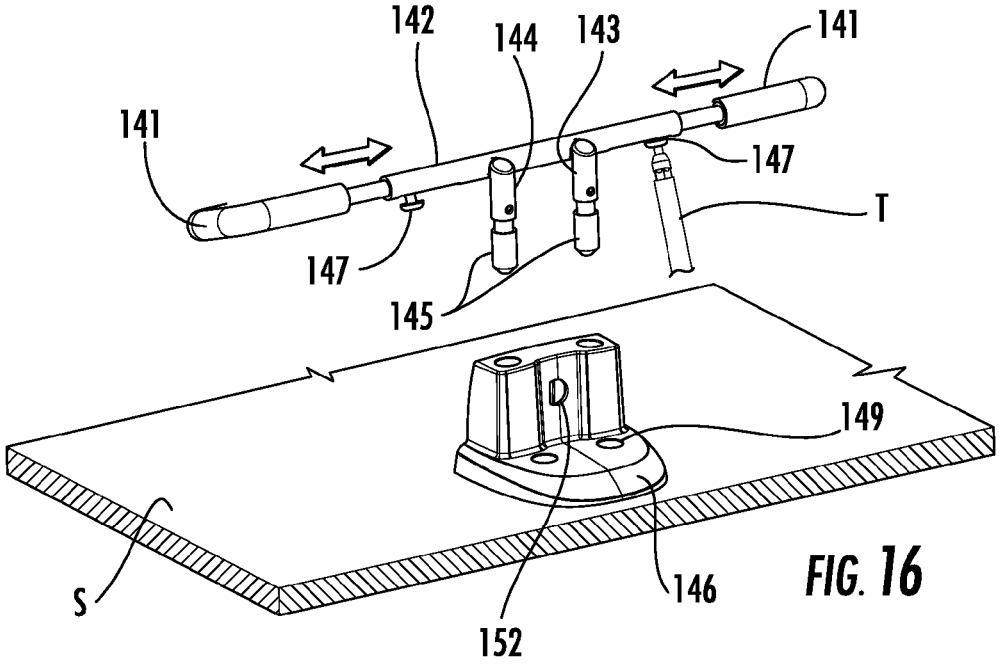
FIG. 16 is a rear perspective view illustrating another exemplary means for adjusting the anti-theft device of FIG. 12 to accommodate laptop computers or similar portable electronic products having various widths in accordance with the present invention.

FIG. 16 illustrates another exemplary means for adjusting the anti-theft device 120 to accommodate laptop computers or similar portable electronic products having various widths. As previously mentioned retaining arm 142 is generally hollow and receives a retaining hook 141 therein at each lateral end of the retaining arm. As a result, the retaining hook 141 is movable (i.e. slidable) relative to the retaining arm 142 in a lengthwise (i.e. lateral) direction as indicated by the arrows in FIG. 16. Accordingly, each retaining hook 141 can be independently positioned at a desired lateral location and secured by a fastener 147 having a proprietary head so as to discourage theft of the laptop computer or similar portable electronic product. Alternatively, fastener 147 may be any common fastener suitable for use with anti-theft devices that do not require enhanced security. As will be readily apparent to one of ordinary skill, either one or both of the retaining hooks 141 may be repositioned in either lengthwise direction to accommodate laptop computers and similar portable electronic products having various widths.

Figure 17:
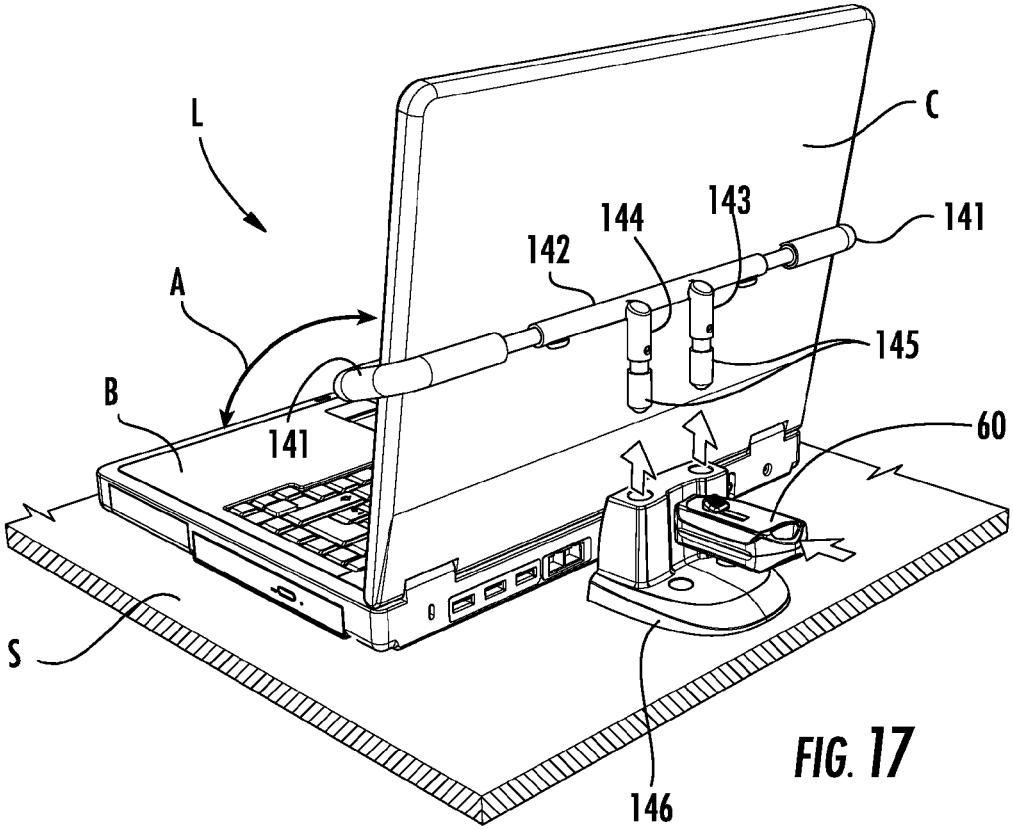
FIG. 17 is a rear perspective view illustrating another exemplary means for unlocking the anti-theft device of FIG. 12 from the locked configuration using a magnetic key in accordance with the present invention.

FIG. 17 illustrates another exemplary means for unlocking the anti-theft device 120 from the locked configuration using the magnetic key 60. As previously mentioned, the magnetic key 60 may be any device suitable for operating a corresponding lock mechanism disposed within the retaining base 146 of the retaining assembly 140. The magnetic key 60 operates to release the foot 145 of each of the retaining legs 143, 144 from the openings 146A formed in the retaining base 146, and thereby permit the retaining arm 142 to be moved upwardly in the direction indicated by the arrows in FIG. 17 and removed from the retaining base of the retaining assembly 140. Once the retaining arm 142 is free of the retaining base 146 and the cover portion C, the lateral edges of the laptop computer L are out of engagement with the retaining hooks 141, and if desired, the laptop computer L can be removed from the support surface S. As will be readily apparent to one of ordinary skill in the art, the retaining base 146 of the retaining assembly 140 may be provided with either a single or a "dual" lock mechanism (not shown) that is operated by a single magnetic key 60 as described herein without departing from the invention. Furthermore, the retaining assembly 140 may be provided with an alternative type of lock mechanism and a corresponding key for unlocking the anti-theft device 120 to permit removal of a laptop computer or similar portable electronic product without departing from the invention.

The foregoing has described one or more exemplary embodiments of an anti-theft device for protecting a laptop computer or similar portable electronic product from theft or unauthorized removal. Anti-theft devices according to the invention may include a means for positioning and automatically locking the anti-theft device onto the laptop computer or similar portable electronic product. Anti-theft devices according to the invention may also include a means for adjusting the anti-theft device to accommodate laptop computers or similar portable electronic products having various widths. Anti-theft devices according to the invention may further include a means for unlocking the anti-theft device from the laptop computer or similar portable electronic product using a magnetic key. In particularly advantageous embodiments, the invention is an anti-theft device for a laptop computer including an adjustment mechanism that permits sliding movement of one or more laterally extending retaining arms in a lengthwise direction that terminate in a retaining hook for engaging a lateral edge of the laptop computer, and a lock mechanism that prevents the retaining arm from being removed from the anti-theft device. Although exemplary embodiments of the present invention have been shown and described, it will be apparent to those skilled in the art that various modifications thereto can be made without departing from the spirit and scope of the invention. Accordingly, the foregoing description of exemplary embodiments of the invention and the best mode for practicing the invention are provided for the purpose of illustration only, and not for the purpose of limitation. In particular, it will be appreciated that an anti-theft device constructed in accordance with the present invention may be applicable for use with items of merchandise, products and objects other than laptop computers or similar portable electronic products without departing from the spirit and scope of any appended claim.

That which is claimed is:

1. An anti-theft device for protecting an item from theft or unauthorized removal, comprising:

at least one retaining assembly, the retaining assembly comprising a retaining arm terminating in a retaining hook for engaging a lateral edge of the item, the retaining arm being adjustable to accommodate items having various widths; and a lock mechanism for locking the retaining arm in a locked configuration wherein the item cannot be removed from the anti-theft device, wherein the at least one retaining assembly further comprises a retaining base and the retaining arm comprises at least one retaining leg depending from the retaining arm that is received within the retaining base in the locked configuration.

2. An anti-theft device according to claim 1, wherein the lock mechanism engages the at least one retaining leg in the locked configuration to lock the retaining arm relative to the retaining base.

3. An anti-theft device according to claim 2, wherein the lock mechanism automatically engages the at least one retaining leg in the locked configuration.

4. An anti-theft device according to claim 1, wherein the retaining base is secured to a support surface.

5. An anti-theft device according to claim 4, wherein the retaining base is secured to the support surface by at least one of a pressure sensitive adhesive (PSA) and a fastener having a proprietary head.

6. An anti-theft device according to claim 1, further comprising a rail that is secured to a support surface and wherein the retaining base is movable in a lengthwise direction along the rail to a desired lateral location.

7. An anti-theft device according to claim 6, wherein the retaining base is adjustably secured to the rail by a fastener having a proprietary head and wherein the rail is secured to the support surface by a fastener having a proprietary head.

8. An anti-theft device according to claim 1, wherein the at least one retaining base is secured to a support surface and wherein the retaining hook is adjustably secured to the retaining arm by a fastener having a proprietary head.

9. An anti-theft device according to claim 1, wherein the lock mechanism is disposed within the retaining base and comprises a shuttle and a biasing spring for biasing the shuttle into engagement with the at least one retaining leg.

10. An anti-theft device according to claim 9, wherein the lock mechanism further comprises a collar made of a magnetically attractive material and wherein the lock mechanism is operable with a magnet to impart a magnetic attraction force against the biasing force of the biasing spring to move the shuttle out of engagement with the retaining arm from the locked configuration to an unlocked configuration.

11. An anti-theft device according to claim 1, wherein the at least one retaining leg comprises a foot movably connected to a lower portion of the at least one retaining leg and wherein the foot is movable relative to the at least one retaining leg within the retaining base to permit the lock mechanism to lock the retaining arm in the locked configuration.

12. An anti-theft device according to claim 11, further comprising a biasing spring disposed between the lower portion of the retaining leg and the foot for permitting movement of the foot relative to the retaining leg and a pivot pin connecting the foot to the lower portion of the retaining leg for permitting movement of the foot relative to the retaining leg.

13. An anti-theft device for protecting an item from theft or unauthorized removal, comprising:

at least one retaining assembly comprising a laterally extending retaining arm for engaging a lateral edge of the item in a locked configuration;

a means for adjusting a lateral location of the retaining arm to accommodate items having various widths;

a means for locking the retaining arm of the anti-theft device onto the item in a locked configuration; and a means for unlocking the retaining arm of the anti-theft device from the locked configuration to an unlocked configuration to thereby remove the item from the anti-theft device;

wherein the at least one retaining assembly further comprises a retaining base having an opening formed therein and the retaining arm comprises a retaining leg depending from the retaining arm that is received within the opening formed in the retaining base in the locked configuration; and wherein the means for locking the retaining arm automatically engages the retaining leg in the locked configuration.

14. An anti-theft device according to claim 13, wherein the retaining arm is generally hollow and terminates in a movable retaining hook, and wherein the means for adjusting a lateral location of the retaining arm comprises a fastener having a proprietary head for securing the retaining hook within the retaining arm at a desired lateral location.

15. An anti-theft device according to claim 13, wherein the means for adjusting a lateral location of the retaining arm comprises a rail secured to a support surface and wherein the retaining base is adjustably secured to the rail and movable in a lengthwise direction along the rail to position the retaining arm at a desired lateral location.

16. An anti-theft device according to claim 13, wherein the means for locking the retaining arm comprises a lock mechanism disposed within the retaining base, and wherein the retaining leg of the retaining arm comprises a foot movably connected to a lower portion of the retaining leg and received within the opening formed in the retaining base in the locked configuration with the lock mechanism engaging the foot of the retaining leg.

17. An anti-theft device according to claim 13, wherein the means for unlocking the retaining arm comprises a lock mechanism disposed within the retaining base, and wherein the retaining leg of the retaining arm is received within the retaining base in the locked configuration with the lock mechanism engaging the retaining leg and the lock mechanism is unlocked by a magnet.

18. An anti-theft device for protecting a laptop computer or similar portable electronic product from theft or unauthorized removal, the anti-theft device comprising:

at least one retaining assembly comprising a laterally extending retaining arm terminating in a retaining hook for engaging a lateral edge of the laptop computer or similar portable electronic product and having a retaining leg depending therefrom and a retaining base configured for receiving the retaining leg of the retaining arm in a locked configuration, the retaining arm being adjustable to a desired lateral location to accommodate laptop computers or similar portable electronic products having various widths; and a lock mechanism comprising a shuttle fixed to a collar made of a magnetically attractive material and a biasing spring for biasing the shuttle into engagement with the retaining leg of the retaining arm, the lock mechanism being operable with a magnetic key to impart a magnetic attraction force to the shuttle against a biasing force of the biasing spring to move the shuttle out of engagement with the retaining leg of the retaining arm to unlock the retaining arm from the retaining base and thereby permit the retaining arm to move to an unlocked configuration wherein the laptop computer or similar portable electronic product may be removed from the anti-theft device.

* * * * *